US006438973B1

(12) United States Patent
Yoshida et al.

(10) Patent No.: US 6,438,973 B1
(45) Date of Patent: Aug. 27, 2002

(54) CONTROL BOARD ALARMS

(75) Inventors: Kazuhiro Yoshida, Peachtree City; Donald Dunn, Senoia; Robert McDonald, Sharpsburg; William P. Kirsch, Newnan, all of GA (US); Robert B. Allen, Richlands, NC (US)

(73) Assignee: Hoshizaki America, Inc., Peachtree City, GA (US)

( * ) Notice: Subject to any disclaimer, the term of this patent is extended or adjusted under 35 U.S.C. 154(b) by 0 days.

(21) Appl. No.: 09/562,103

(22) Filed: May 1, 2000

(51) Int. Cl.[7] ..... F25B 49/00

(52) U.S. Cl. ..... 62/126; 62/230; 62/228.3; 361/33; 361/34

(58) Field of Search ..... 62/126, 230, 228.3, 62/229, 228.1; 361/22, 24, 28, 29, 30, 31, 33, 34

(56) References Cited

U.S. PATENT DOCUMENTS

| | | | | | |
|---|---|---|---|---|---|
| 3,743,442 | A | | 7/1973 | Wilson | |
| 3,864,611 | A | | 2/1975 | Chang | |
| 3,946,574 | A | | 3/1976 | Portera | |
| 3,950,675 | A | | 4/1976 | Weber et al. | |
| 4,079,432 | A | * | 3/1978 | Godfrey | 361/22 |
| 4,084,406 | A | | 4/1978 | Brenneman | |
| 4,117,526 | A | | 9/1978 | Bates | |
| 4,171,533 | A | | 10/1979 | Schrader | |
| 4,196,462 | A | * | 4/1980 | Pohl | 361/33 |
| 4,286,303 | A | * | 8/1981 | Genheimer et al. | 361/24 |
| 4,415,943 | A | | 11/1983 | Wortman | |
| 4,502,084 | A | | 2/1985 | Hannett | |
| 4,510,547 | A | | 4/1985 | Rudich, Jr. | |
| 4,584,623 | A | | 4/1986 | Bello et al. | |
| 4,631,624 | A | | 12/1986 | Dvorak et al. | |
| 4,653,285 | A | * | 3/1987 | Pohl | 62/126 |
| 4,912,936 | A | | 4/1990 | Denpou | |
| 5,035,118 | A | * | 7/1991 | Hara | 62/126 |
| 5,113,665 | A | * | 5/1992 | Katsuki | 62/126 |
| 5,357,395 | A | | 10/1994 | Bissell et al. | |
| 5,379,606 | A | * | 1/1995 | Katsuki et al. | 62/126 |
| 5,455,469 | A | | 10/1995 | Ward | |
| 5,463,874 | A | * | 11/1995 | Farr | 62/126 |
| 5,488,834 | A | * | 2/1996 | Schwarz | 62/126 |
| 5,537,834 | A | * | 7/1996 | Farr | 62/126 |
| 5,596,471 | A | | 1/1997 | Hanlin | |
| 5,801,911 | A | | 9/1998 | Goto et al. | |
| 5,872,704 | A | | 2/1999 | Kim | |
| 6,119,469 | A | * | 9/2000 | Elwood | 62/126 |
| 6,216,479 | B1 | * | 4/2001 | Elwood | 62/230 |

* cited by examiner

*Primary Examiner*—Tu Ba Hoang
*Assistant Examiner*—Fadi H. Dahbour
(74) *Attorney, Agent, or Firm*—Arent Fox Kintner Plotkin & Kahn, PLLC

(57) ABSTRACT

Electronic circuitry provides protection for refrigeration machines by continuously monitoring supply voltage conditions and various other conditions. Information regarding abnormalities detected in the refrigeration machines or supply voltage is stored in a memory. The stored information may then be downloaded from the memory by a service technician. The electronic circuitry is universal and can therefore be used with various refrigeration machines. Further, the efficiency of a low temperature storage cabinet is enhanced by cycling the evaporator motor in comparison to a compressor percentage run time. Other factors are also considered in the running of the reach-in cabinet evaporator fan.

16 Claims, 6 Drawing Sheets

CONTROL BOARD ALARMS

BACKGROUND OF THE INVENTION

The present invention relates to a protective device and control board having a plurality of functions for protecting, monitoring, and controlling a refrigeration or freezer machine.

SUMMARY OF THE INVENTION

The present invention is a control board for an ice machine, refrigerator or other refrigeration machinery having a protective circuitry that continuously monitors a supply voltage for both over voltage and under voltage conditions. The protective circuitry comprises a delay that prevents it from disconnecting the refrigeration machinery from the supply voltage during startup or detected temporary abnormalities. The protective circuitry also comprises at least one low and high temperature sensor, a pressure sensor, a door position sensor, a dirty filter sensor, a thermistor sensor, a defrost sensor, a communication error sensor and a pump down error sensor which may provide a shutdown signal to turn the protected refrigeration machinery off. The protective circuitry further comprises a diagnostic menu which facilitates service personnel during troubleshooting operations by providing a history of detected irregularities in the refrigeration machine operation.

An object of the invention is to monitor and protect motor circuitry and other electronic components in a refrigeration machine from harmful environmental conditions such as over voltage, under voltage, high temperature, and high pressure conditions.

A further object of the invention is to provide a control board that continuously monitors various environmental conditions, shuts down a protected refrigeration machine after a dangerous condition exists for a predetermined period of time and/or a predetermined number of occurrences and stores information concerning the dangerous condition such as number of occurrences, date and time of occurrences or other information necessary for service technicians to troubleshoot and repair a faulty condition.

An additional object of the invention is to provide a control board which is controllable by an input device and contains an interface for communicating between input/output devices such as laptops or palm top computers or other similar devices. The control board may also receive or supply information remotely via a modem, or other transmission device including landline, cellular, satellite, or other communication mediums.

Another object of the invention is to provide a control board which has a delay that allows continuous use of a refrigeration machine without interruption due to ramping of motors, compressors, ect.

Another object of the invention is to provide a control board which is universal and can therefore be used in various refrigeration machines, thereby realizing cost savings. Input/Output (I/O) ports used in one configuration may be used for a different function in a different configuration or mode merely by changing software functions through various techniques such as calling up an already stored software module or routine or downloading/uploading additional software programs. The software functions may be loaded at the factory and may be changed at a retail store or in the field by a service technician.

DETAILED DESCRIPTION

Figure 1A:
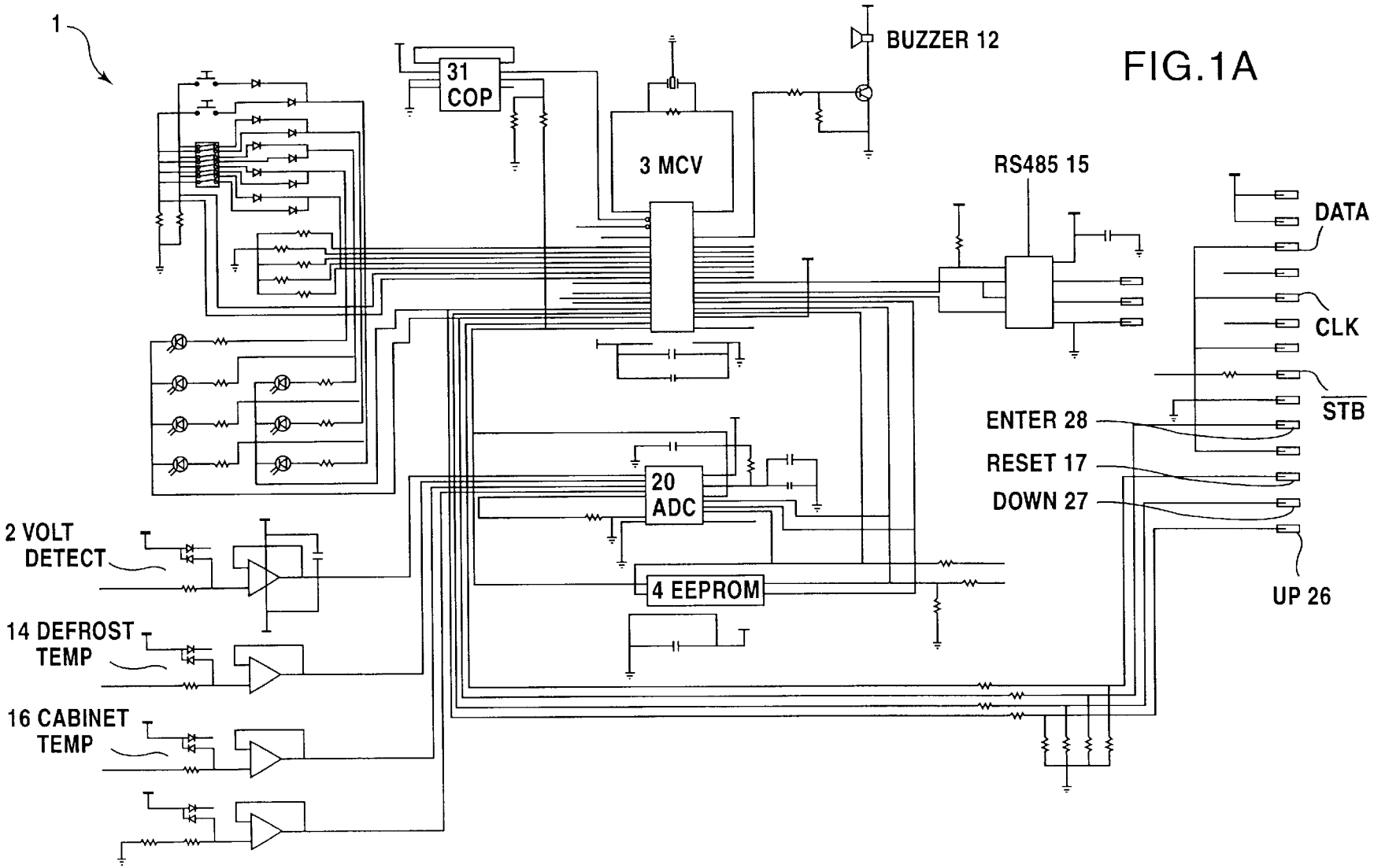
FIGS. 1A and 1B depict schematic views of the control board operating within a refrigeration machine.

The present invention is a control board comprising a temperature control output for regulating a temperature in a compartment of a refrigeration machine by energizing a compressor. A defrost control output controls a duration of a defrost cycle in the refrigeration machine by raising the temperature in the compartment of the refrigeration machine. An evaporator fan control relay controls an evaporator fan. A door position contact indicates whether a door to the compartment of the refrigeration machine is open, ajar or closed. A condenser fan/pump down relay controls a condenser fan. The control board further comprises outputs including audible and visual alarming devices. A high pressure input receives an input signal indicating excessive or high pressure in the cooling system. A communication device is for communicating between another control board and/or an interface device by importing or exporting information between one another. A temperature input receives a temperature signal indicating an environmental or compartmental temperature. A reset input resets the control board to default settings. A clean filter input receives a signal indicative of the cleanliness of a filter. A thermistor error input receives a signal indicative of whether a cabinet sensor and/or an evaporator sensor readings are out of predetermined range. A door ajar input receives a signal from the door open contact. A communications error input receives a signal indicative of a problem with communications between two boards or an interface between the control board and an external input/out put device. A pump down error input receives a signal indicating a problem with the pump down mode of operation described below. An onboard programmable memory stores a set of instructions or routines which control the refrigeration machine and alert a user of harmful conditions to protect the refrigeration machine. A DIP switch switches the functions or reconfigures the operations of the control board. A power loss memory stores the set of instructions or routines and information relating to harmful conditions which may be downloaded to facilitate troubleshooting by a service technician.

In a second embodiment the board further comprises a low pressure input device for terminating a pump down mode.

In a third embodiment the board is switchable between a freezer and a refrigerator board.

In a final embodiment two control boards are connected via a serial interface connection.

Throughout the disclosure the terms micro-controller and software program are used interchangeably and it should be realized and recognized that direct references to the various sequences, modules and/or routines could be implemented with various electronic circuitry, hardware, or software in combination or separately to implement the disclosed invention.

The control board comprises several outputs which may include a temperature control output that is a relay output to energize an external compressor control contactor that controls the operation of a compressor. A set point for temperature is programmed via up/down arrows on a display board. A switching function allows for toggling between Fahrenheit or Celsius temperature displays. The. control board also controls on/off time values for compressor cycles. The minimum on/off time values are stored in an EEPROM/EPROM or similar types of memory storage devices. When an alarm requests turn off of the compressor, the minimum on time will be disabled allowing the compressor to shut off immediately. At startup, by pressing the reset and enter buttons on the display board simultaneously while turning the power switch on, the cooling cycle can be immediately started. Nothing else can disable compressor minimum compressor off time which is at least 2.5 minutes.

A defrost control output is a defrost element control relay. In a freezer mode, defrost parameters are programmed via up/down arrows on a display board. Defrost cycle termination is determined by temperature. For example, when the control board is configured to be in a freezer mode, the freezer defrost cycle may be terminated when the compartment temperature reaches 100° F. or if configured in the refrigerator mode defrost termination may commence when the compartment reaches 40° F.

The software routine controlling the control board may also comprise a subroutine having a minimum or maximum time period between termination of a defrost cycle and initiation of the next cycle. A default setting for an initial defrost cycle commencement may be 6 hours from the time of power up. Refrigeration defrost may also commence when an evaporator temperature is 13° F. and may include no minimum time between defrost cycles. The defrost cycle during a freezer mode can be automatically terminated if the defrost termination temperature is not reached within one hour of commencement of a defrost operation. During a freezer mode "DEF" is displayed on the display board when a defrost relay is energized and the display on the display board may return to a cabinet temperature when a cabinet temperature sensor falls below a preset value such as 15° F. above a programmed set point. In the refrigerator mode, the display board always shows the compartment temperature. In freezer mode, the compressor start up may be delayed up to five minutes after termination of a defrost cycle. In the refrigerator mode, startup of the compressor is delayed 2.5 minutes.

An evaporator fan control relay is controlled by an output from the control board. There are two programmable options for the evaporator fan during a freezer mode. In one embodiment, the evaporator fan runs continuously or runs inverse to the state of the compressor. Namely, the evaporator fan is off while the compressor is running, and on when the compressor is off unless the fan is set to be running continuously. The evaporator fan is off during defrost and start up of the evaporator fan is delayed until the evaporator temperature is below 25° F. In another embodiment, the ambient temperature conditions in a refrigeration compartment are monitored and when the ambient temperature conditions exceed a predetermined threshold value, the evaporator fan motor is operated synchronously with a compressor motor. However, the evaporator fan is operated continuously when a monitored compressor percentage run time for a compressor in refrigeration machine reaches a threshold level. That is, when the compressor percentage run time reaches a certain low level, the evaporator motor will run continuously.

There are two programmable options for the evaporator fan during normal run operation (cooling) in a refrigerator mode. The evaporator fan operates the same as in the freezer mode. The board when operating in the refrigerator mode has two programmable options for the evaporator fan during defrost. The evaporator fan is on during defrost or is off during defrost and start up of the evaporator fan is delayed until the evaporator temperature is below 35° F.

The control board may comprise several inputs. A door open contact is activated by a signal from a door switch. However, if the refrigeration machine has a glass door, an output may be used to control a door heater. Additionally the control board may be constructed such that various types of contacts may be used for indicating whether a door is open or not. The control board may comprise a feature which is selectable between an open contact and a closed contact through a DIP switch. The control board therefore monitors the time the door is open and performs an alarm at after a predetermined period of time is exceeded. This function may be disabled if the refrigerator/freezer has a glass door on the compartment through a DIP switch. A reset operation of this alarm function is performed if the door is closed.

A high pressure input is provided to the control board by a pressure sensor reading exceeding a predetermined threshold value. Likewise, the low pressure input is provided by a pressure sensor which may be in common with the same source providing the high pressure input. If either input is triggered a predetermined number of times within a predetermined period of time, then a specific error code is displayed on the display board for a specified period of time. When the specific error code is displayed a predetermined period of time, the error message may be displayed continuously on the display board. The buzzer may also be triggered to sound a predetermined number of times within a specified period of time to indicate a high pressure condition and may be deactivated by a reset on the display or reset button the control board. The compressor may likewise assume an off condition when the error code is determined and displayed within a specific period of time. A visual alarm such as a LED may be triggered if the high pressure condition is determined to exist. The memory may record the error conditions every time they occur or after a predetermined number of error occurrences within a predetermined period of time.

A programming input may comprise up/down arrows, an enter button and a reset button. The display board update time is stored in a nonvolatile EEPROM.

A high voltage low voltage input is connected to the control board 1 or connected circuitry such that a sensor detects when a voltage exceeds a predetermined value. If a high voltage condition exists the display board will indicate as much. The low voltage alarm will indicate a low voltage, likewise. The occurrences of these harmful conditions may be recorded in a memory by a memory storage function. This memory storage function may apply to all harmful conditions.

A condenser fan/pump down relay output may be provided with the control board. In a freezer mode this relay 10 is energized any time the compressor relay 6 is energized and de-energized anytime the compressor relay 6 is de-energized. In a refrigerator mode during normal run (cool) cycle, this relay 10 is energized any time the compressor relay 6 is energized and de-energized anytime the compressor relay 6 is de-energized except during a defrost cycle when the condenser fan/pump down is energized 10 and the compressor relay 6 is not. Thus, the logic output in highs or lows of the control of the compressor is the same as the condenser fan/pump down relay 10 during a normal run cycle in the refrigerator mode and inverse during a defrost cycle. The condenser fan is off when the high-pressure switch indicates that a high pressure condition exists a predetermined number of times within a preset time period.

In the pump down mode, the control board relinquishes control of the condenser fan. Therefore, the condenser fan continues operating in the mode it was in before the control board relinquished its control of the condenser fan. For example, if the condenser fan was in an on state before the control board ceases control of it, then the condenser fan will continue to remain on. If however, the condenser fan was off before the control board relinquishes control, it will remain off. Additionally, in this mode the output on the board relay is used to drive a pump down solenoid. During a default operation the control board will not control condenser fan operation. When the compartment temperature reaches cut-out temperature which equals a set point minus a differential value, the compressor continues to run while the pump down solenoid relay is de-energized. But, when the low pressure switch is energized the compressor relay is de-energized. If the compressor is running, and a defrost mode is initiated, a delay is implemented during which the solenoid valve relay de-energizes while the compressor continues to run. Further, when the compressor relay de-energizes, the low pressure switch assumes a position indicating that a low pressure condition exists and may remain in such position for some period of time after the compressor restarts for the next cycle. For a restart, when the temperature is at cut on temperature which equals a set point plus a differential value, both the pump down solenoid relay and the compressor relay are energized. If the set point is not reached, the low pressure switch is ignored. If a "cut out" or "turn off" temperature is reached which equals a set point minus a differential while the low pressure switch is de-energized within a predetermined period of time, then the compressor shuts off. If the compressor shuts off a predetermined number of times within a predetermined period of time then the pump down mode will be converted to the standard run mode and a specific error code will be displayed on the display board. This mode may be controllable through a DIP switch.

Inputs for the control board may also comprise the following. A clean condenser filter contact closure is sensed from a filter sensor which may be indicated by both buzzer and visual alarm outputs.

Temperature sensors include a compartment sensor displayed on the display board. The temperature reading display may be updated regularly over a predetermined period of time. A defrost termination/fan control sensor readings initiates defrost termination. For a non-heated refrigerator defrost, this sensor may initiate the defrost.

A control board reset switch 32 is a momentary push button switch located on the control board for resetting the alarms. A control board test switch 31 (shown in FIG. 1A)is a momentary push button switch located on the control board for cycling all relays in sequence, one at a time.

A programming menu comprises adjustable parameters accessible through "guarded access" to prevent unauthorized changes. Display of the programming sequence will revert automatically to compartment temperature display after a predetermined period of time after the last button on the display board 7 is pressed. All parameters are programmable through an up/down arrows 26, 27 on the display board 7. Access will be granted only by pressing and holding the up/down arrows 26, 27 together for a predetermined period of time. Once access has been obtained the display board will show parameter designators and current values. Adjustable parameters may include a temperature set point "t"; a defrost frequency "dF"; and a Fahrenheit/Celsius selection.

The control board may also comprise alarm outputs which may be controllable. For example, high and low temperature alarms are disabled during a defrost cycle. Audible alarms may be disabled through control of a DIP switch in desired modes.

The control board may also comprise preprogrammed default conditions upon sensor failure. For example, if a compartment temperature sensor fails, the compressor will operate on a fixed percentage on-time basis. For example, a control board in the refrigerator mode may be control a compressor to be five minutes on and five minutes off. In the freezer mode the compressor may be ten minutes on and three minutes off. If the defrost sensor fails, the control board may initiate a defrost cycle after a predetermined period of time.

The control board may also include various alarm messages displayed on the display board and/or stored in the memory. These alarm messages may include a clean filter error message. A service required error message. "DEF" may be displayed on the display board when the control board is in a defrost cycle. A thermistor error indicates when a cabinet sensor and/or evaporator sensor readings are out of range. A high compartment temperature alarm is disabled during the defrost cycle. However, after a predetermined period of time above a preset value, the temperature sensor in the cabinet will indicate an error code. Likewise, a low compartment temperature may be indicated through an alarm output.

A defrost error may cause termination of a defrost cycle and resume or default to a refrigeration cycle if a defrost cycle has not been completed within a predetermined period of time. A communications error will be indicated if a communications is not established with another board. A diagnostic menu may be provided by gaining access by pressing and holding the keypads displayed on the display board for predetermined periods of times in various sequences.

DETAILED DESCRIPTION OF PREFERRED EMBODIMENT

Figure 1B:
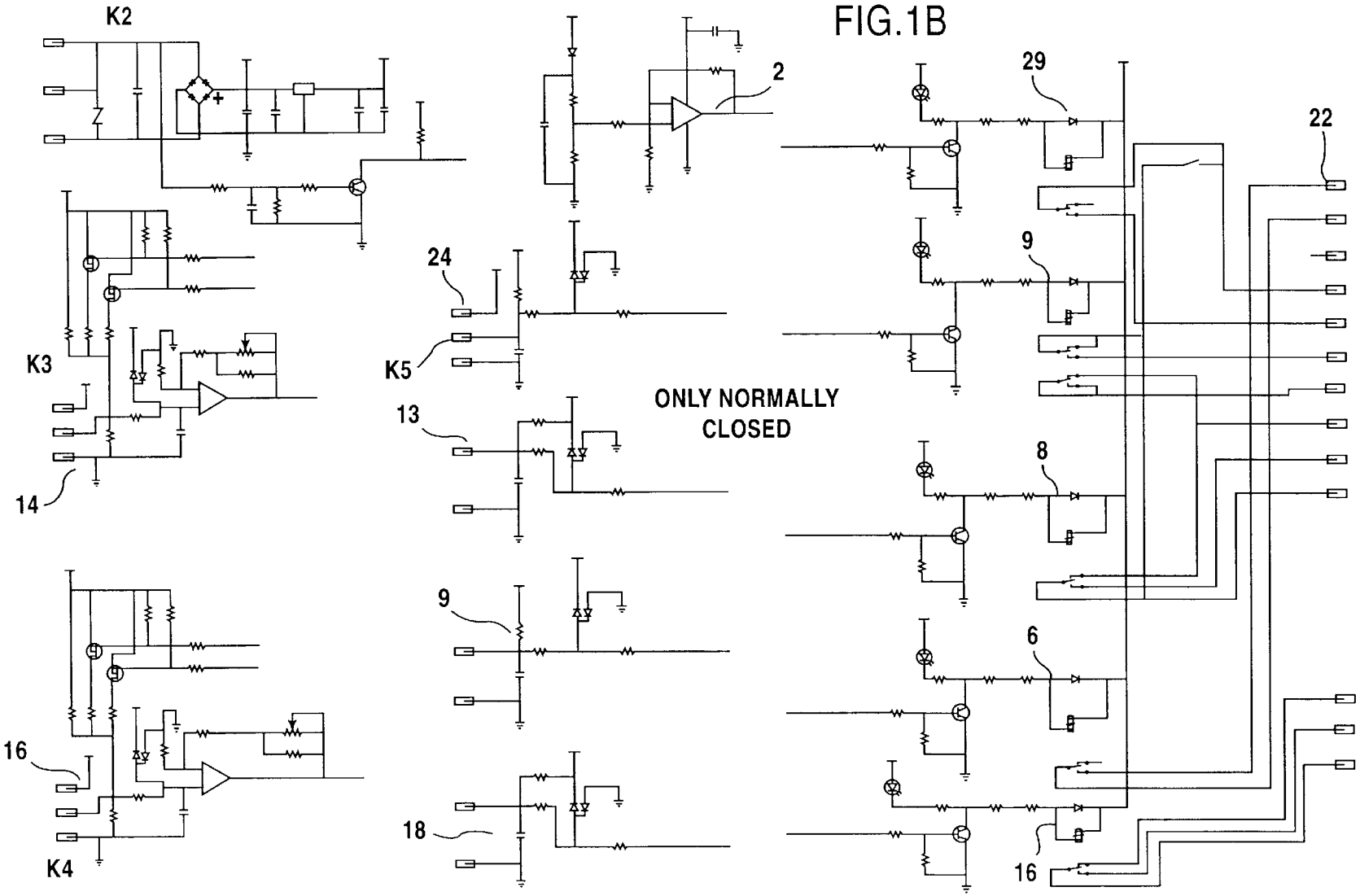
Figure 2:
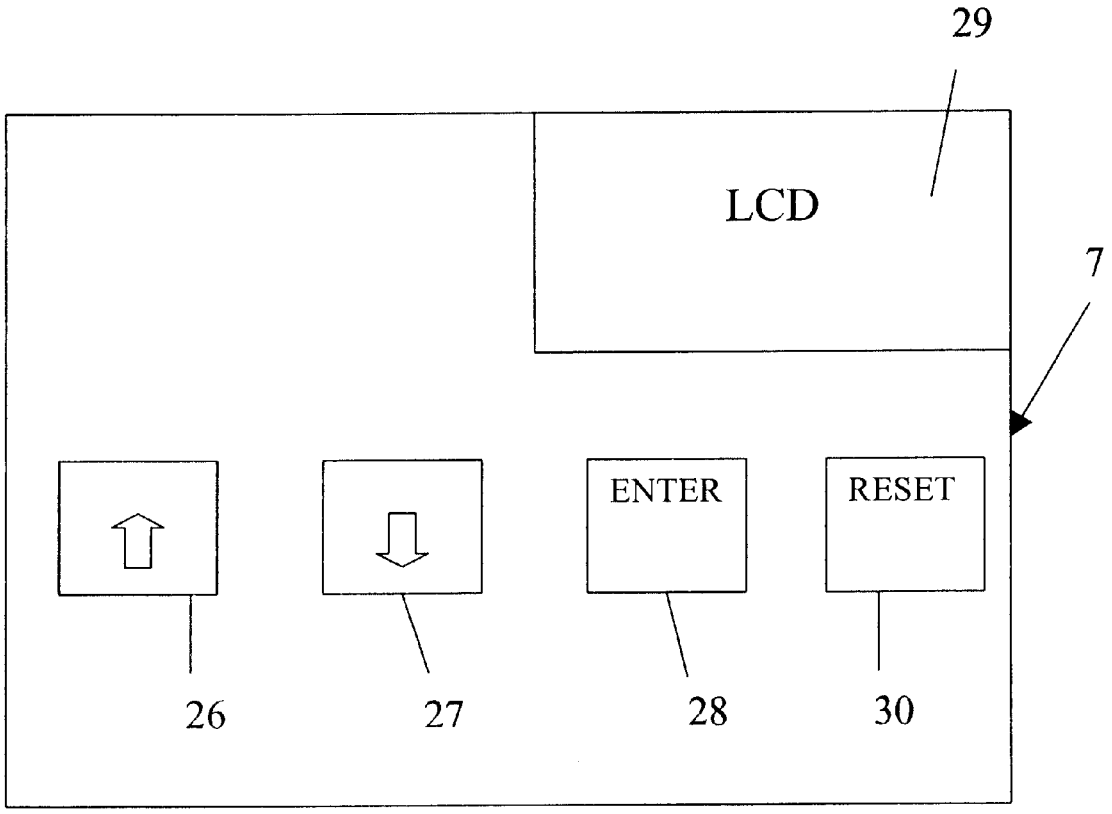
FIG. 2 depicts a frontal view of an input control panel of the control board.

FIG. 1A depicts a schematic of the control board 1. For ease in understanding, only some of the inputs to the micro-controller unit 3 are shown in FIG. 1B. Voltage detection sensor 2, defrost temperature sensor 14, and cabinet or compartment temperature sensor 16 have outputs fed into an analog-to-digital converter 20 which are then digitized and relayed to the micro-controller unit 3 for analysis. An EEPROM 4 is connected in parallel with the micro-controller unit 3 to the output of the analog-to-digital converter 20. The EEPROM 4 stores information such as operational faults, number and time of occurrences which may be accessed by a service technician to help in trouble-shooting a faulty condition. Several inputs corresponding to the input buttons on the display board including an enter button 28 for entering and selecting information displayed on LCD display screen 11 as shown in FIG. 2. Reset button 17 resets the micro-controller unit 3 to factory installed default settings. Up arrow 26 and down arrow 27 are used to scroll between functions and inputs on LCD display screen 11. The micro-controller unit 3 drives both the LCD display screen 11 and buzzer 12.

FIG. 1B depicts schematic views of voltage detection sensor 2, defrost temperature sensor 14, cabinet or compartment temperature sensor 16, low and high pressure sensors 24, 13, door open sensor 9, clean filter sensor 18, evaporator fan relay 9, defrost heater relay 29, compressor relay 6, and condenser relay 10.

FIG. 2 shows an arrangement of buttons on the display board 7. Up arrow button 26 and down arrow button 27 are used to scroll between information items displayed on LCD 11. Reset button 17 is used for resetting the control board 1 to default settings programmed at the factory. Enter button 28 allows entry of selected features such as defrost or temperature set points chosen by scrolling through a programmed menu with up arrow 26 and down arrow 27.

Figure 3:
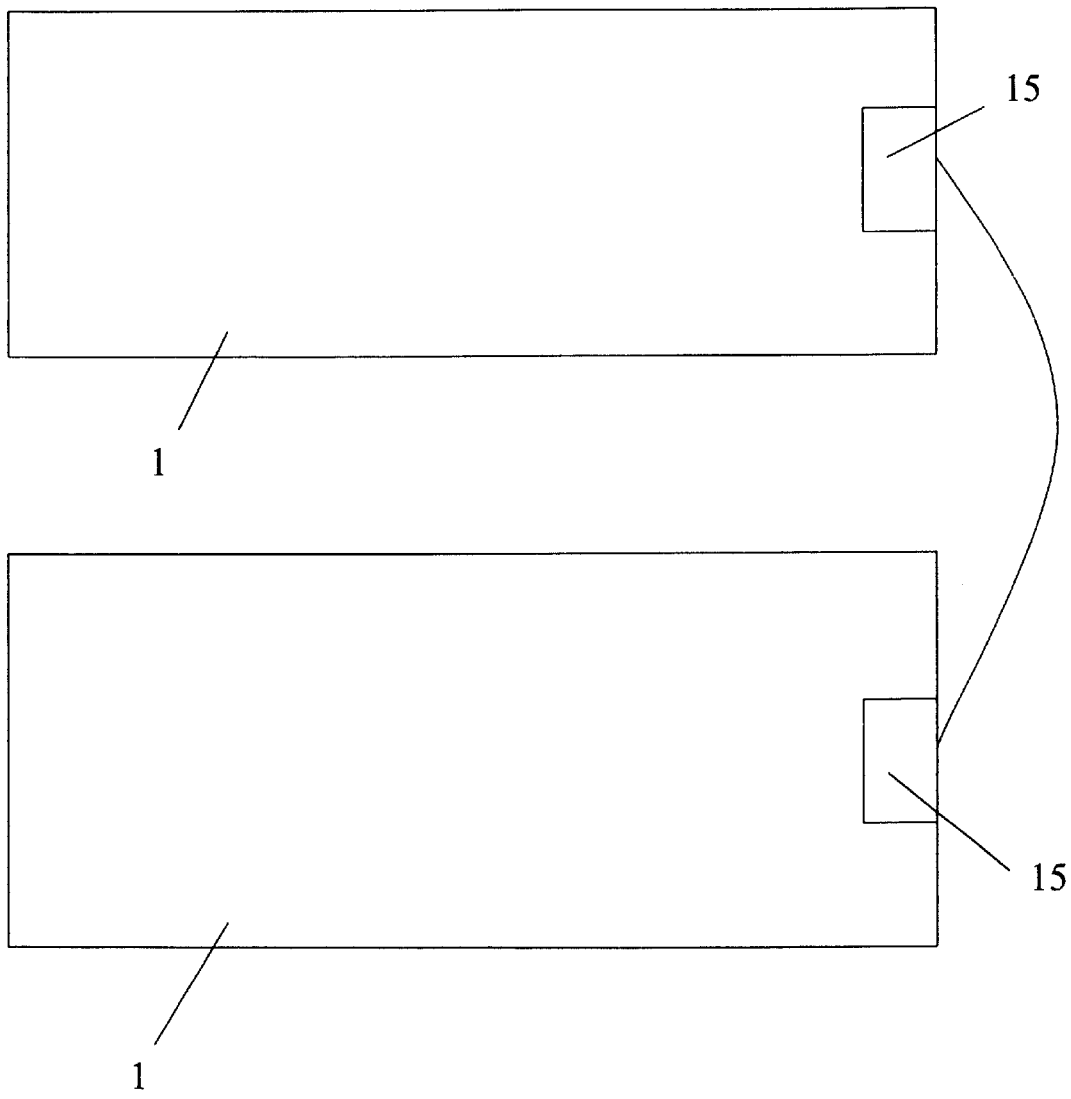
FIG. 3 depicts a two board operation within a refrigerator/freezer machine.

FIG. 3 depicts a block diagram of two boards connected together via communication ports 15 on each board 1. One of the boards is configured in a freezer mode while the other is configured in the refrigerator mode. The dual temperature unit mode may be enabled with a DIP switch 22. Two boards will operate together where one board is configured as a freezer and the other is configured as a refrigerator. To prevent an overload condition from occurring and therefore a circuit breaker from tripping, the two compressors will not start at the same time. The two boards will communicate between each other to determine when a compressor has been turned on. When a board determines that its compressor should be turned on, the board 1 will check to see how long it has been since the other board 1 has turned on its compressor and will start its compressor depending on when the other compressor was started, if at all. If one board cannot establish communications with the other board, it will delay for a period of time and again try to establish communications with the other board. If after a predetermined number of unsuccessful attempts the board does not establish communications with the other board, it will turn its compressor on and initiate a communications error to be displayed on the display board. The display board may be toggled between displaying informational data of the first board and informational data of the second board.

Figure 4:
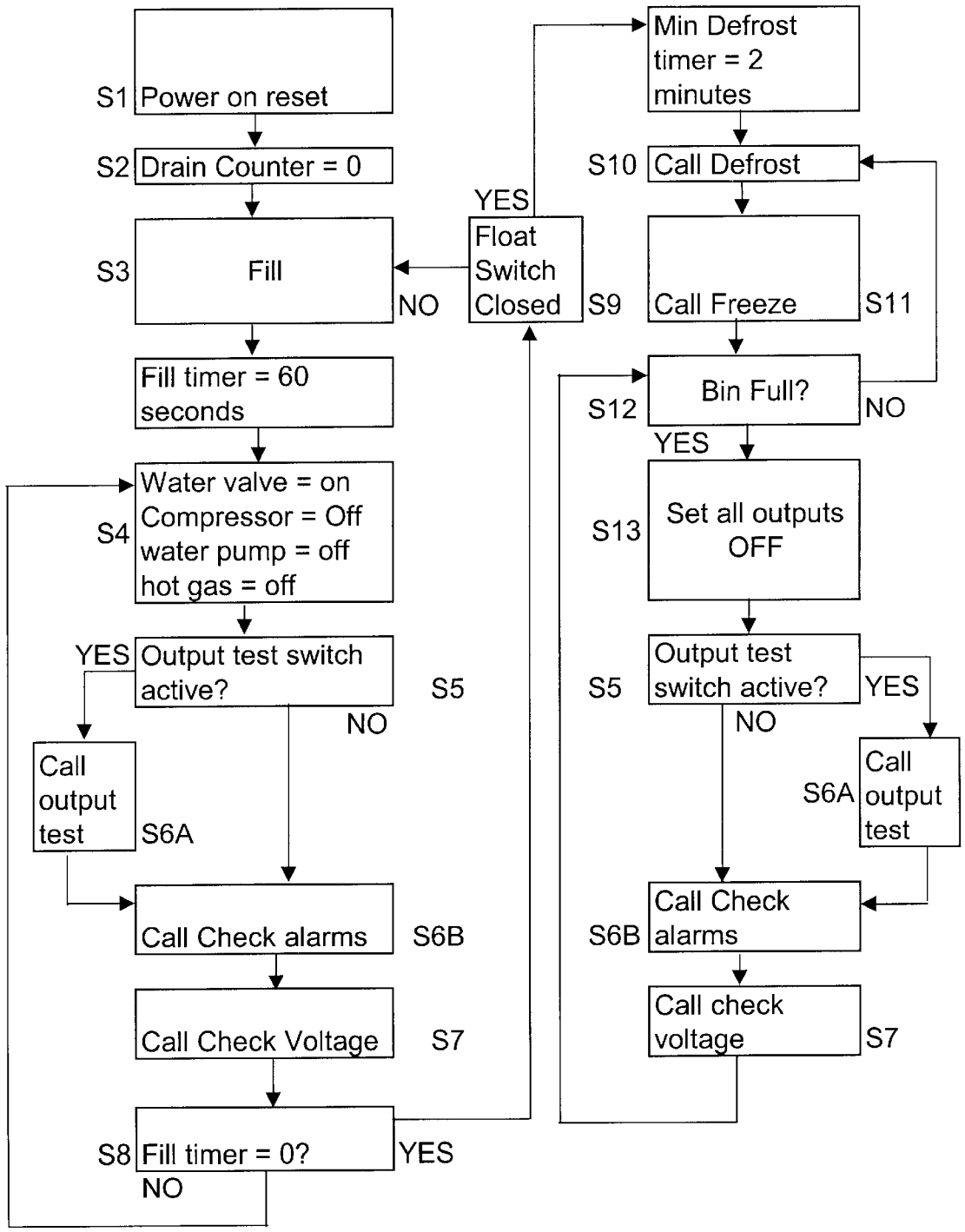
FIG. 4 depicts a flowchart of a software program for implementing an embodiment of the control board while in a freezer mode.
Figure 5:
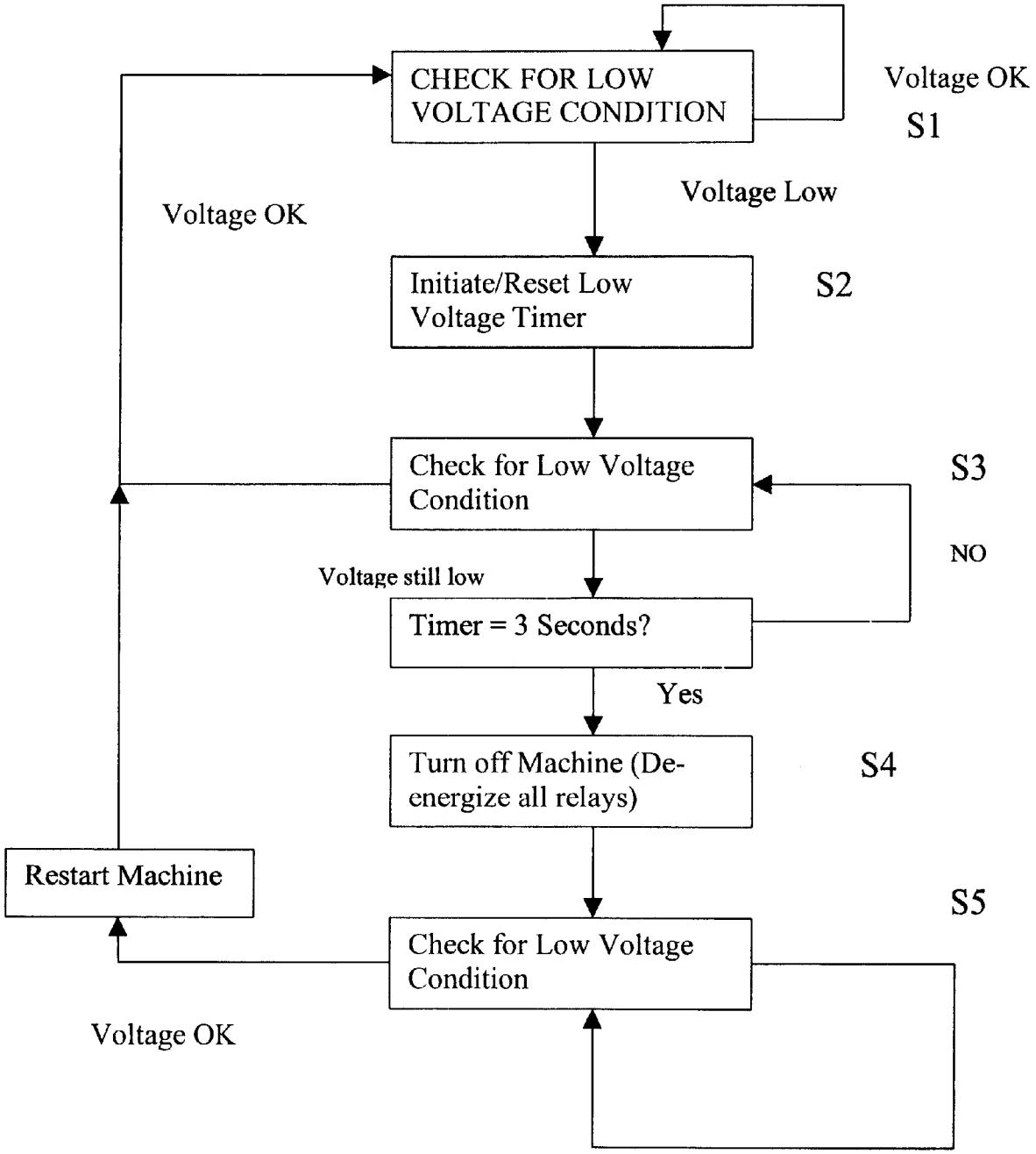
FIG. 5 depicts a low voltage alarm sequence.

FIG. 4 is a flowchart of a freezer operation for an ice making machine. In step S1, power is turned on to the control board 1 through a power up sequence or a reset sequence. In step S2, a drain counter is reset to zero. In step S3, a sump is filled with water for a predetermined period of time. For illustrative purposes the fill timer is set to equal 60 seconds in the present embodiment. In step S4, the micro-controller checks the status of a water valve that supplies water for the ice making process and insures that it is on. The status of the compressor, water pump and hot gas used for defrost are also confirmed to be in the appropriately shown conditions. In step S5, an output test switch position is determined. If the micro-controller 3 determines that the output test switch position is in an active position then an output test is performed in step S6A on the sensors and relays to ensure that the ice making machine is operating properly. However, if the output test switch is inactivated, then the micro-controller begins checking the on-board alarms in step S6B. In step S7, the supply voltage to the ice making machine is checked for over voltage, under voltage or other dangerous conditions. In step S8 the fill timer is monitored to determine whether the predetermined period of time has expired. If the predetermined period of time has not expired the routine returns to step S4 as shown in FIG. 4. However, if the time period has expired then the routine moves to step S9 and the micro-controller determines whether a float switch is closed. If the float switch is open then the ice making machine returns to step S3 and continues to fill the sump. If the float switch is closed then a minimum defrost time is set to a default or programmed time value. In this embodiment the time value for the minimum defrost time is 2 minutes. Next, in step S10 the micro-controller calls up a defrost routine and the freezing tube or molding compartment is defrosted. Upon completion of the defrost routine, a freeze routine is called in step S11 and the water in the freezing tube or molding compartment is frozen. The ice is then dumped into a storage bin which is monitored to determine whether it is full in step S12. If the bin is not full, the micro-controller will again call the defrost routine in step S10. If the bin is full, then all controlling outputs from the micro-controller, such as compressor on, water on, etc., are set to an off position and the micro-controller returns to steps S5 through S7. This sequence avoids an unnecessary shutting down of the compressor in the middle of a freezing cycle.

An ice making machine embodiment is next disclosed. A control board comprises several outputs. For example, a compressor is controlled by a relay output from the micro-controller and is off during an initial fill cycle. The compressor is on during an initial fill cycle and on during freeze and defrost cycles. A hot gas output is on during the defrost cycle and off during freeze, fill, and drain cycles. A water pump relay is energized during the drain cycle at the start of the defrost. A water valve output is on during a fill cycle and a predetermined period of time during the defrost cycle.

Alarm outputs may include an audible alarm and may also include LEDs, or LCD displayed error messages or other visual alarms.

The control board also includes various inputs. A frequency detect input detects zero cross inputs from an AC voltage for determining line frequency. Temperature sensor inputs may include an evaporator sensor and a bin control sensor. The evaporator sensor is used to begin a harvest timer and monitor an evaporator for high temperature. The bin control sensor is used to determine if the bin is full. A float switch input is monitored during a freeze cycle to determine when to end the freeze cycle and begin a defrost cycle. For example, when water in a water storage tank is used up, the float switch will open to end the freeze cycle.

Next the operation of the ice making machine will be disclosed. During a power up sequence the micro-controller will delay all outputs for a predetermined period of time while waiting for voltage and sensor readings to stabilize, thereby assuring accurate readings. In one embodiment the predetermined period of time is 5 seconds.

During a fill sequence the water valve output is on and all other outputs are off for a predetermined period of time. The float switch is then checked. If the float switch is energized then a defrost sequence is activated. If the float switch is deenergized then a second fill sequence will be conducted. The float switch is also checked each time the ice making machine begins a freeze cycle. If the float switch is de-energized at the start of a freeze sequence, the micro-controller will call up a fill sequence. An open float position of the float switch indicates no water in the water tank.

During a defrost sequence the compressor and hot gas outputs are on. If a drain counter equals zero, then a drain sequence is executed and the water valve is turned on. If the defrost cycle lasts longer than a predetermined period of time, which may be 6 minutes, then the water valve is turned off for the rest of the defrost sequence. While an evaporator temperature is less than a temperature set point, which may be 48° F. the defrost timer may be reset to a value based on a switch setting. When an evaporator temperature reaches or exceeds the temperature set point, the defrost timer will no longer be reset and will begin to count down. The defrost sequence will be terminated when the defrost timer equals zero. The defrost sequence is typically executed after fill and freeze sequences. The drain counter may be set to a value depending on a switch setting. After a defrost sequence one is subtracted from the drain counter. For example, a DIP switch controlling the drain count may be set for a drain counter of 5 cycles. The drain sequence will be executed only once every fifth defrost sequence. If the drain counter is set for every defrost cycle, the drain sequence will not be executed during the first defrost after power on. The defrost sequence may have a minimum and maximum run time based a switch setting.

During a drain sequence, a unit delay will be implemented after which a delay water pump output will turn on for a predetermined period of time based on a switch setting. Upon completion of a drain sequence, the micro-controller will return to a defrost sequence.

At the beginning of a freeze sequence, the position of the float switch is checked. If the float switch is de-energized, the freeze sequence is terminated and a fill sequence is initiated. If the float switch is energized indicating that the water tank is full, the freeze sequence will continue and the compressor will remain on while all other outputs will be off. After a minimum freeze time period, the float switch will be monitored. When the float switch indicates that the water supply in the water tank is exhausted, the freeze sequence is terminated and a defrost sequence commences. The freeze cycle may also have a maximum run time.

Alarm scenarios include high evaporator temperature, defrost backup timer, shorted ice bin thermistor, open ice bin thermistor, low and high voltage.

What is claimed is:

1. An electronic control board for controlling a refrigeration machine comprising:

a micro-control unit located on said control board;

a voltage monitor for continuously monitoring a supply voltage and inputting a signal to said micro-control unit representative of a voltage level;

an electronic circuit connected to said micro-control unit for producing a delay time period in which alarm functions controlled by said control board are temporarily disabled for allowing starting of the refrigeration machine; and an electronic memory circuit for storing data relating to detected abnormal operational occurrences and connected to said micro-control unit;

wherein said data stored in said electronic memory circuit is accessible by an interface device.

2. An electronic control board for controlling a refrigeration machine comprising:

a micro-control unit located on said control board;

a voltage monitor for continuously monitoring a supply voltage and inputting a signal to said micro-control unit representative of a voltage level;

an electronic circuit connected to said micro-control unit for producing a delay time period in which alarm functions controlled by said control board are temporarily disabled for allowing starting of the refrigeration machine;

an electronic memory circuit for storing data relating to detected abnormal operational occurrences and connected to said micro-control unit; and a switch connected to the control board for electrically reconfiguring the electronic control board;

wherein said data stored in said electronic memory circuit is accessible by an interface device.

3. The electronic control board of claim 2 further comprising:

a display board for displaying at least said data and connected to said micro-control unit.

4. The electronic control board of claim 2 further comprising:

a frequency input means for detecting a zero crossing of a current in a supply voltage and connected to said micro-control unit.

5. The electronic control board of claim 2 further comprising:

a temperature input means for inputting a temperature value and connected to said micro-control unit.

6. The electronic control board, of claim 2 further comprising:

a float switch input means for indicating the position of a float switch and connected to said micro-control unit.

7. The electronic control board of claim 2 further comprising:

a compressor relay output means for controlling an operation of a compressor and connected to said micro-control unit.

8. The electronic control board of claim 2 further comprising:

a hot gas output control means for controlling an output of a hot gas and connected to said micro-control unit.

9. The electronic control board of claim 2 further comprising:

a water pump relay output means for controlling a water pump and connected to said micro-control unit.

10. The electronic control board of claim 2 further comprising:

a water valve output means for controlling a water valve and connected to said micro- control unit.

11. The electronic control board of claim 2 further comprising:

at least one alarm output means for controlling an alarm and connected to said micro-control unit.

12. A method for controlling a refrigeration machine comprising:

detecting a zero crossing of a current in a supply voltage supplying the refrigeration machine;

indicating the position of a float switch to a controller which controls the refrigeration machine;

controlling an output of a hot gas to defrost a compartment in said refrigeration machine;

controlling a water pump for supplying water to said refrigeration machine;

controlling a water valve for draining or supplying water to said refrigeration machine;

monitoring environmental operating conditions existing in said refrigeration machine;

storing data relating to detected abnormal operating conditions in a memory located on said controller; and controlling an alarm to indicate that a detected abnormal operating condition exists in said refrigeration machine.

13. The method of controlling a refrigeration machine as in claim 12 further comprising:

monitoring ambient temperature conditions in a refrigeration compartment and when said ambient temperature conditions exceed a predetermined threshold value the evaporator fan motor is operated synchronously with a compressor motor.

14. The method of controlling a refrigeration machine as in claim 12 further comprising:

monitoring a compressor percentage run time for a compressor in said refrigeration machine;

continuously operating an evaporator fan motor when the compressor percentage run time reaches a threshold level.

15. An electronic control board for controlling a refrigeration machine comprising:

a micro-control unit located on said control board;

means for continuously monitoring a supply voltage and inputting a signal to said micro-control unit representative of a voltage level;

means connected to said micro-control unit for producing a delay time period in which alarm functions controlled by said control board are temporarily disabled for allowing starting of the refrigeration machine; and means for storing data relating to detected abnormal operational occurrences connected to said micro-control unit;

wherein said data stored in said storing means is accessible by an interface device.

16. An electronic control board for controlling a refrigeration machine comprising:

a micro-control unit located on said control board;

means for continuously monitoring a supply voltage and inputting a signal to said micro-control unit representative of a voltage level;

means connected to said micro-control unit for producing a delay time period in which alarm functions controlled by said control board are temporarily disabled for allowing starting of the refrigeration machine;

means for storing data relating to detected abnormal operational occurrences and connected to said micro-control unit; and means for electrically reconfiguring the electronic control board connected to the control board;

wherein said data stored in said storing means is accessible by an interface device.

* * * * *